US009127904B2

(12) United States Patent
Moore, Jr.

(10) Patent No.: US 9,127,904 B2
(45) Date of Patent: Sep. 8, 2015

(54) BAYONET LUG TO PICATINNY RAIL ADAPTOR

(71) Applicant: Garin Loy Moore, Jr., Tower City, PA (US)

(72) Inventor: Garin Loy Moore, Jr., Tower City, PA (US)

( * ) Notice: Subject to any disclaimer, the term of this patent is extended or adjusted under 35 U.S.C. 154(b) by 0 days.

(21) Appl. No.: 13/940,117

(22) Filed: Jul. 11, 2013

(65) Prior Publication Data

US 2014/0033593 A1 Feb. 6, 2014

Related U.S. Application Data

(60) Provisional application No. 61/679,763, filed on Aug. 5, 2012.

(51) Int. Cl.

| | |
|---|---|
| ***F41C 27/18*** | (2006.01) |
| ***F41C 27/00*** | (2006.01) |
| ***F41G 11/00*** | (2006.01) |
| ***F41C 23/16*** | (2006.01) |

(52) U.S. Cl.

CPC ..... *F41C 27/00* (2013.01); *F41C 23/16* (2013.01); *F41C 27/18* (2013.01); *F41G 11/003* (2013.01)

(58) Field of Classification Search

CPC ..... F41C 27/16; F41C 27/18; F41C 27/00; F41C 23/16; F41G 11/003

USPC ..... 42/86; 89/1.42

See application file for complete search history.

(56) References Cited

U.S. PATENT DOCUMENTS

| | | | | |
|---|---|---|---|---|
| 3,076,280 | A * | 2/1963 | Bervoets | 42/86 |
| 4,383,371 | A * | 5/1983 | Coffey | 42/124 |
| 4,903,425 | A * | 2/1990 | Harris | 42/94 |
| 6,289,621 | B1 | 9/2001 | Vendetti et al. | |
| 7,240,451 | B2 * | 7/2007 | Blair | 42/124 |
| 7,578,090 | B1 * | 8/2009 | Romaszka | 42/96 |
| 7,712,242 | B2 * | 5/2010 | Matthews et al. | 42/90 |

* cited by examiner

*Primary Examiner* — Stephen M Johnson
(74) *Attorney, Agent, or Firm* — Lyman H. Smith

(57) ABSTRACT

An adaptor allows accessories to be mounted to the bayonet lug rather than a Picatinny rail mounted to the hand guard of a rifle. The adaptor of the present invention allows accessories to be used while not interfering with the proper grip on the hand guard and without the need to replace the hand guard with one that has an integrated Picatinny rail.

4 Claims, 3 Drawing Sheets

BAYONET LUG TO PICATINNY RAIL ADAPTOR

CROSS-REFERENCE TO RELATED APPLICATION

This application claims the benefit of priority of U.S. provisional application No. 61/679,763, filed Aug. 5, 2012, the contents of which are herein incorporated by reference.

BACKGROUND OF THE INVENTION

The present invention relates to rifle accessories and, more particularly, to a bayonet lug to Picatinny rail adaptor for AR style rifles.

AR15 M4 style rifles have very short hand guards. Accessories on existing Picatinny rail hand guards do not leave enough room for proper grip on the rifle.

Current replacement hand guards with integrated Picatinny rails are not as ergonomic as factory hand guards and space for accessories is at a minimum, even on the replacement hard guards.

As can be seen, there is a need for a device to allow accessories to be mounted to the bayonet lug rather than the Picatinny rail mounted to the hand guard of a rifle.

SUMMARY OF THE INVENTION

In one aspect of the present invention, a bayonet lug to Picatinny rail adaptor comprises adaptor arms disposed on a top side of the adaptor to form a bayonet lug slot along the top side thereof; a rail disposed on a bottom side of the adaptor, the rail operable to permit a user to attach an accessory thereto; and a lock operable to lock the adaptor to the bayonet lug.

In another aspect of the present invention, a bayonet lug to Picatinny rail adaptor comprises adaptor arms disposed on a top side of the adaptor to form a bayonet lug slot along the top side thereof; a rail disposed on a bottom side of the adaptor, the rail operable to permit a user to attach an accessory thereto; a lock slot on a first side of the adaptor; a lock fitting into the lock slot; threads in a portion of the lock, the threads providing an adjustment of the lock to apply pressure on a bayonet lug to secure the adaptor thereto; and a shoulder screw hole in a second, opposite side of the adaptor, wherein a screw inserted into the shoulder screw hole threads into the threads of the lock.

These and other features, aspects and advantages of the present invention will become better understood with reference to the following drawings, description and claims.

DETAILED DESCRIPTION OF THE INVENTION

Figure 1:
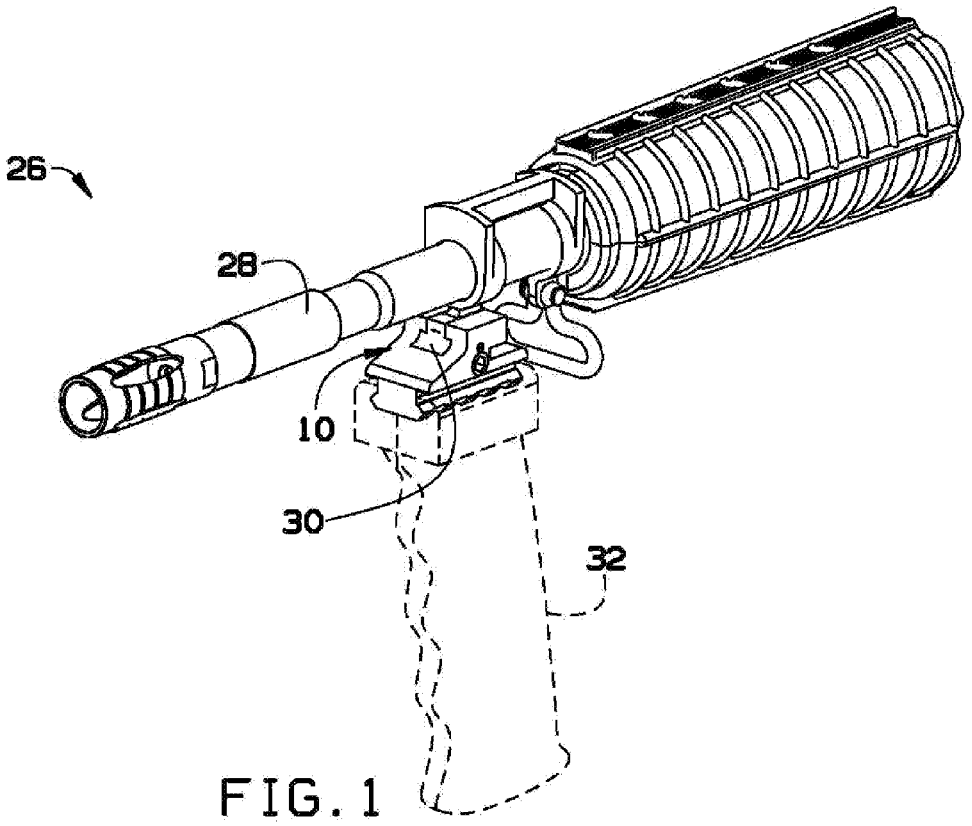
FIG. 1 is a perspective view of a bayonet lug to picatinny rail adaptor, in use on an AR-15 rifle, according to an exemplary embodiment of the present invention.
Figure 3:
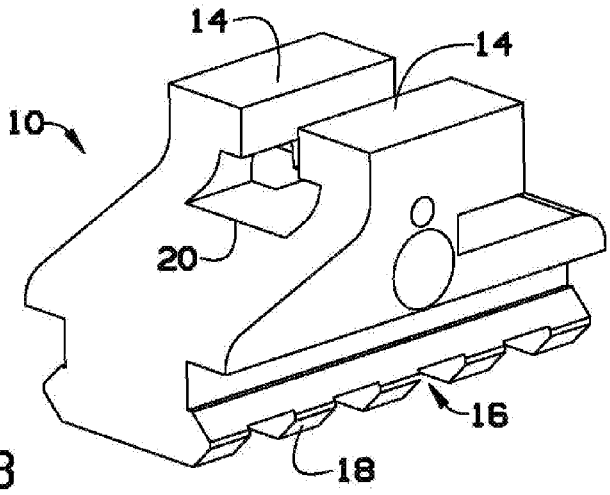
FIG. 3 is a top perspective view of the bayonet lug to picatinny rail adaptor of FIG. 1.
Figure 2:
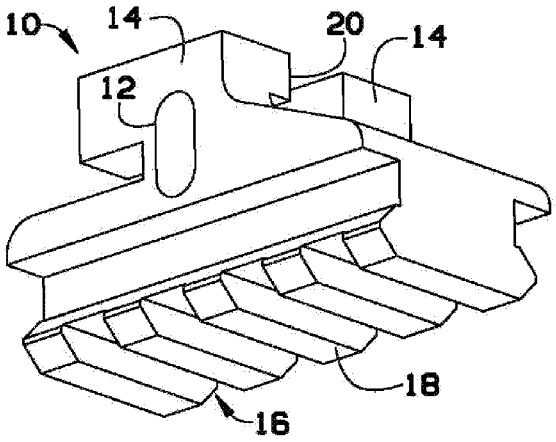
FIG. 2 is a bottom perspective view of the bayonet lug to picatinny rail adaptor of FIG. 1.
Figure 4:
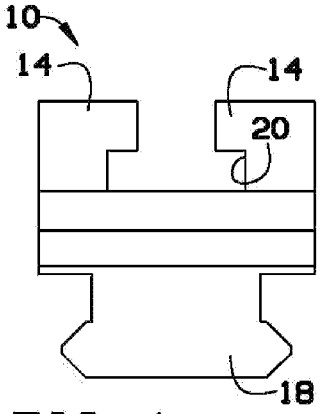
FIG. 4 is a front view of the bayonet lug to picatinny rail adaptor of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an adaptor that allows accessories to be mounted to the bayonet lug rather than a Picatinny rail mounted to the hand guard of a rifle. The adaptor of the present invention allows accessories to be used while not interfering with the proper grip on the hand guard and without the need to replace the hand guard with one that has an integrated Picatinny rail.

Referring to FIGS. 1 through 6, a bayonet lug to Picatinny rail adaptor 10 (also referred to simply as adaptor 10) can include a bayonet lug clamp that can interface with a bayonet lug 30 on a rifle barrel 28, such as those found on an AR15 rifle 26. A Picatinny rail 16, having a plurality of rail teeth 18, can be machined integrally with the bayonet lug clamp, resulting in a Picatinny rail 16 in place of the bayonet lug 30. The Picatinny rail 16 can be used to mount various accessories 32, as described below.

Figure 5:
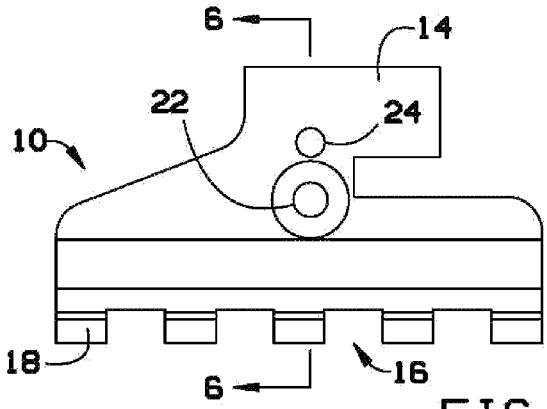
FIG. 5 is a side view of the bayonet lug to picatinny rail adaptor of FIG. 1.
Figure 6:
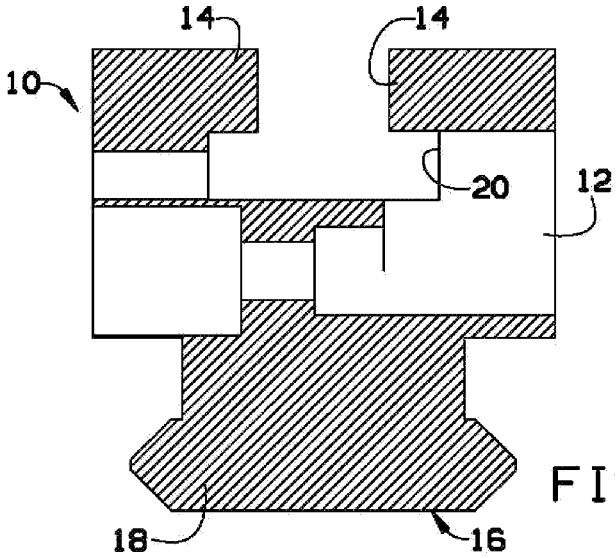
FIG. 6 is a cross-sectional view taken along line 6-6 of FIG. 5.
Figure 7:
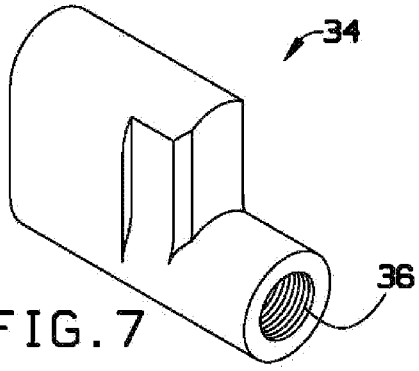
FIG. 7 is a perspective view of a lock used with bayonet lug to picatinny rail adaptor of FIG. 1.
Figure 8:
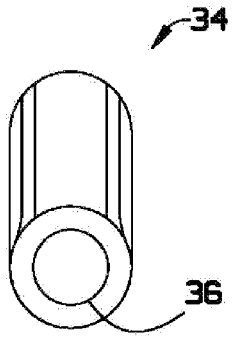
FIG. 8 is a front view of the lock of FIG. 7.
Figure 9:
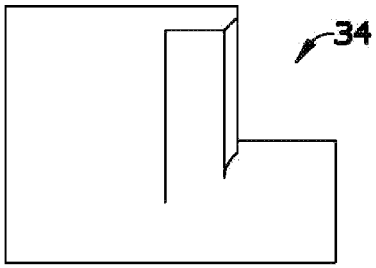
FIG. 9 is a side view of the lock of FIG. 7.
Figure 10:
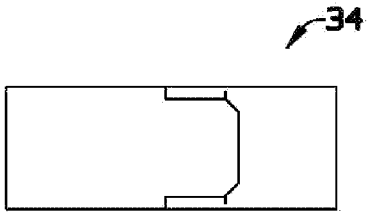
FIG. 10 is a top view of the lock of FIG. 7.
Figure 11:
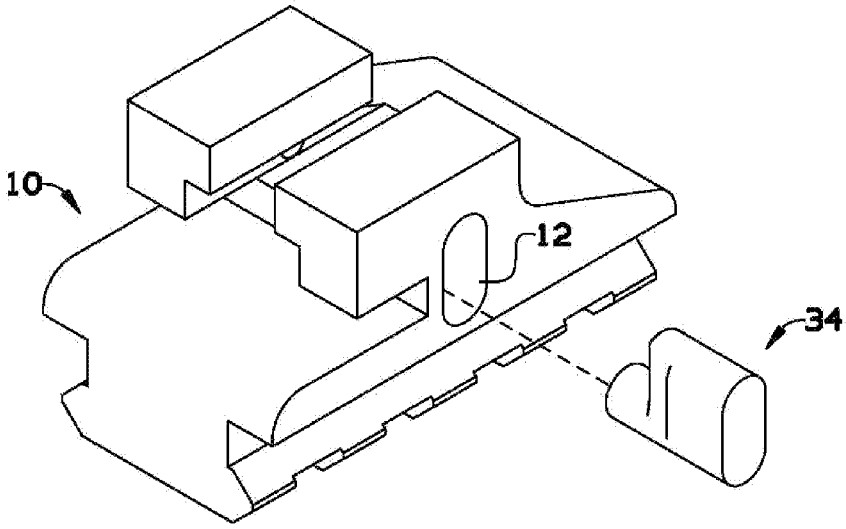
FIG. 11 is a perspective view of bayonet lug to picatinny rail adaptor of FIG. 1, illustrating insertion of the lock of FIG. 7.

As shown in FIG. 5, a small threaded hole 24 can be used to accommodate a set screw. The set screw can be used to better secure the adaptor 10, which may be especially useful in semi-permanent installations.

The bayonet lug clamp can be formed of an adapter arm 14 that forms a bayonet lug slot 20 shaped to accept the bayonet lug 30 of the rifle 26.

The bayonet lug to Picatinny rail adaptor 10 can be made from various materials, such as steel, aluminum, or the like.

In some embodiments, the bayonet lug to Picatinny rail adaptor 10 can include a spring loaded release button (not shown) that, when depressed, actuates a locking paw (not shown), causing a locking pin (not shown) to move in and out of a bayonet lug mount via a pin hole in the adaptor 10. This design provides a convenient way to quickly and easily mount and dismount the bayonet lug to Picatinny rail adaptor 10 of the present invention, with or without the integrated accessories 32 as described below.

As shown in FIGS. 7 through 11, a lock 34 can be shaped to fit into a lock slot 12 formed in the adaptor 10. A shoulder screw hole 22 can be formed in one side of the adaptor 10 and can communicate with the lock slot 12 formed in an opposite side of the adaptor 10, as shown, for example, in FIG. 6. The lock 34 can include threads 36 formed so that when a screw is inserted into the shoulder screw hole 22, the screw can thread into the threads 36 to move the lock 34 to retain the adaptor 10 in a desired position on the bayonet lug 30.

Various accessories 32, such as a bi-pod or pistol grip, can be connected to or integrated with the adaptor 10 of the present invention. In some embodiments, an accessory holder, such as a split ring, can be attached to or integrated with the adaptor 10 of the present invention and the adaptor 10 can be secured to the bayonet lug of the rifle. In this split ring embodiment, various accessories, such as a flashlight, laser, or the like, and be secured to the rifle via the split ring.

In some embodiments, a user can attach the adaptor 10 of the present invention to each of their accessories 32, where the user then has a selection of accessories 32 that can readily attach to the bayonet lug 30. Then, the user can simply attach the adaptor 10 to the bayonet lug 30 of the rifle 26 to attach each accessory 32. In other embodiments, a user can attach the adaptor 10 of the present invention to the bayonet lug 30 of the rifle 26 and interchange various accessories 32 on the Picatinny rail provided by the adaptor 10.

While the above describes an adaptor that converts a bayonet lug to a Picatinny rail, the adaptor of the present invention could be used to convert a bayonet lug to any other type of accessory mounting rail system, such as a Weaver rail, a NATO rail, or the like.

It should be understood, of course, that the foregoing relates to exemplary embodiments of the invention and that modifications may be made without departing from the spirit and scope of the invention as set forth in the following claims.

What is claimed is:

1. A bayonet lug to Picatinny rail adaptor comprising:

first and second adaptor arms disposed on a top side of the adaptor to form a bayonet lug slot along the top side thereof;

a rail disposed on a bottom side of the adaptor, the rail operable to permit a user to attach an accessory thereto;

a lock slot formed in the first adaptor arm;

a lock operable to lock the adaptor to the bayonet lug, the lock fitting into the lock slot; and a shoulder screw hole in the second adaptor arm, wherein a screw inserted into the shoulder screw hole threads into threads of the lock to cause a pressure to be exerted by the lock against the bayonet lug.

2. The bayonet lug to Picatinny rail adaptor of claim 1, further comprising a threaded hole formed in one side of the adaptor, the threaded hole communicating with the bayonet lug slot formed by the adaptor arms.

3. A bayonet lug to Picatinny rail adaptor comprising:

first and second adaptor arms disposed on a top side of the adaptor to form a bayonet lug slot along the top side thereof;

a rail disposed on a bottom side of the adaptor, the rail operable to permit a user to attach an accessory thereto;

a lock slot on a first side of the adaptor, the lock slot communicating with the bayonet lug slot;

a lock fitting into the lock slot, the lock having a first portion communicating with the bayonet lug slot;

threads in a second portion of the lock, the threads providing an adjustment of the lock to apply pressure, by the first portion thereof, on a bayonet lug to secure the adaptor thereto; and a shoulder screw hole in a second, opposite side of the adaptor, wherein a screw inserted into the shoulder screw hole threads into the threads of the lock.

4. The bayonet lug to Picatinny rail adaptor of claim 3, further comprising a threaded hole formed in one side of the adaptor, the threaded hole communicating with the bayonet lug slot formed by the adaptor arms.

* * * * *